US008529366B2

(12) United States Patent
Butler et al.

(10) Patent No.: US 8,529,366 B2
(45) Date of Patent: Sep. 10, 2013

(54) PUTTING AID

(71) Applicant: Greenactive Golf (PTY) Ltd (ZA), Heriotdale (ZA)

(72) Inventors: Lloyd Anthony Butler, Heriotdale (ZA); Ronald Charles Mathews, Heriotdale (ZA); Brian Steinhobel, Heriotdale (ZA)

(73) Assignee: Greenactive Golf (PTY) Ltd (ZA), Heriotdale (ZA)

( * ) Notice: Subject to any disclaimer, the term of this patent is extended or adjusted under 35 U.S.C. 154(b) by 0 days.

(21) Appl. No.: 13/739,763

(22) Filed: Jan. 11, 2013

(65) Prior Publication Data

US 2013/0178303 A1 Jul. 11, 2013

(30) Foreign Application Priority Data

Jan. 11, 2012 (ZA) ..... 2012/00218

(51) Int. Cl.
*A63B 69/36* (2006.01)

(52) U.S. Cl.
USPC ..... 473/265; 473/267

(58) Field of Classification Search
USPC ..... 473/157, 158, 219, 257, 258, 260–265, 473/267, 278, 279
See application file for complete search history.

(56) References Cited

U.S. PATENT DOCUMENTS

| | | | | |
|---|---|---|---|---|
| 4,732,390 | A | 3/1988 | McCollum | |
| 4,913,440 | A | 4/1990 | Ellington | |
| 6,019,685 | A * | 2/2000 | Fonseca et al. | 473/265 |
| 6,669,574 | B1 * | 12/2003 | Riley et al. | 473/264 |
| 6,769,995 | B1 | 8/2004 | Rhodes et al. | |
| 6,840,870 | B1 * | 1/2005 | Froggatte | 473/265 |
| 7,566,277 | B2 * | 7/2009 | Dahl | 473/265 |
| 2008/0227561 | A1 | 9/2008 | Dahl | |
| 2009/0227388 | A1 | 9/2009 | Schmutz | |

* cited by examiner

*Primary Examiner* — Nini Legesse
(74) *Attorney, Agent, or Firm* — Michael Best & Friedrich LLP

(57) ABSTRACT

A putting aid which includes a base plate, guide rails attached to the base plate, which are spaced apart to form a guide passage for a putting stroke, and markers which are engaged with guide rails, each marker being engageable with the ground at a defined position, wherein the base plate and the guide rails are movable leaving the markers at the defined positions.

13 Claims, 8 Drawing Sheets

PUTTING AID

BACKGROUND OF THE INVENTION

This invention relates to golf and is concerned with an aid for practicing putting.

Among the many challenges faced by a golfer is that of being able to putt accurately and consistently. Many golf competitions have been won or lost on a putting green.

The prior art is replete with devices for helping a golfer to achieve competency in putting. Typical prior art documents are the specifications of the following U.S. Pat. Nos. and patent applications: 4,913,440, 4,732,390, 6,769,995, 6,019,685, 6,840,870, 2009227388 and 20080227561.

In a general sense the prior art devices are used to define a path for a swinging golf club. Some of the devices are designed for indoor use. Variations include the use of a mirror or markings to assist a user to position himself correctly relative to a ball and to ensure that a putter is correctly orientated.

The applicant has observed that a golfer may display a reasonable degree of competency when using a putting aid, but is not necessarily capable of producing the same level of skill, in an effective manner, when the putting aid is not available.

An object of the present invention is to provide a putting aid which is adjustable by a user to take account of a change in the user's skill level during training sessions. Additionally, the invention is concerned with a putting aid which facilitates a transition for a user from a practice mode, in which the aid is used, to a play mode in which the aid is dispensed with.

SUMMARY OF INVENTION

The invention provides a putting aid which includes a first ground-engaging base plate, at least first and second guide rails, which are attached to the first base plate, a first surface on the first guide rail, a second surface on the second guide rail, the first surface opposing the second surface, the first and second surfaces being spaced apart by a selected width to form at least part of a guide passage for a putting stroke of a putter, the first and second guide rails being relatively movable to adjust said selected width, at least a first marker engaged with the first guide rail and at least a second marker engaged with the second guide rail, each marker including a respective ground-engaging formation which is engageable with the ground at a respective defined position and wherein the first base plate, and the guide rails, are then movable leaving said markers at said respective defined positions.

The guide rails may be movable simultaneously or independently to adjust the selected width. Each guide rail may, in plan, follow a defined path which may be straight or curved. The last-mentioned feature allows an "inside to square" putting stroke to be practiced.

The guide rails may be movable together with the first base plate, or independently thereof, to leave the markers at the defined positions.

The feature that the width of the passage can be adjusted allows for a change in the skill of a user. An unskilled user may have the guide rails positioned relatively far apart so that a putting stroke, which is not necessarily accurately executed, will not be impeded by the guide rails. A more skilled user, however, would have the guide rails positioned closer to each other—an arrangement which calls for a greater degree of competency in completing a putting stroke so that a putter head does not contact either guide rail. Successful repetitions of a putting stroke in which the head of a putter passes through the passage, defined by the opposing first and second surface, which are preferably substantially vertical and which may be straight or curved (viewed in plan), help to create "muscle memory" in the user.

The first base plate preferably includes a formation to receive a golf ball which is positioned so that a putter head is required to travel a distance between the guide rails before making contact with the golf ball. The formation, e.g. a recess, is preferably such that the golf ball can contact the ground and not a surface of the putting aid. This is to ensure that the golf ball reacts in a way which is not dependent on the nature of the material of the first base plate.

Components of the putting aid are progressively removable from the ground, according to choice. This allows a user to practice a putting technique with the putting aid on a surface which is similar to one that the user is likely to encounter on a golf course.

If the first base plate is used to ensure that the markers are correctly positioned then the base plate can be removed so that the user can practice a putting stroke with the assistance, only, of the guide rails and the markers and, thereafter, with the assistance, only, of the markers. The number of markers which are used can also be varied.

The putting aid may include a second base plate which is engageable with the first base plate in a predetermined configuration. The second base plate may include at least one guide structure which is usable in a manner which is similar to that in which a guide rail is used with the first base plate.

The second base plate may include a formation to receive a golf ball which is positioned so that a putter head is required to travel a distance between the guide rails before making contact with the golf ball.

In a preferred form of the invention, the putting aid includes a second ground-engaging base plate which is engageable with the first base plate in a predetermined configuration, and at least third and fourth markers engaged with the second base plate, each said third and fourth marker including a ground-engaging formation which is engageable with the ground at a defined position and wherein the second base plate is movable leaving said third and fourth markers at said defined positions.

"Ground" as used herein includes an underlying surface e.g. of earth, grass, a mat, a carpet or the like. It is further envisaged that, in one embodiment, the underlying surface of the ground may include a metallic support or a support which exhibits magnetic properties. "Ground-engaging" is also given a wide meaning in that the marker is engageable with the ground in a fairly secure way, and so that it is unlikely that the marker can be moved inadvertently.

The putting aid may be used in combination with a device such as an underlying mat e.g. of a foam material, wherein the ground-engaging formation of each marker is ground-penetrating so that, once moved relative to the first or second base plate, the formation can penetrate the surface of the underlying mat at a respective defined position.

Alternatively, the ground-engaging formation may include a magnet such that the formation will engage with an underlying mat formed of or including a material susceptible to magnetic interaction, e.g. steel. The marker may then be kept at a respective defined position through the interaction of the magnet with the metallic mat. Alternatively the mat (ground) may be formed of a material exhibiting magnetic properties such that a marker, which includes a metallic material susceptible to magnetic interaction, is held on the surface at a respective defined position by the interaction of the magnetic marker with the surface.

Each guide rail may include one or more formations, preferably on an undersurface, which are engageable with complementary formations on an upper surface of the first base plate, to help in positioning the guide rail at a desired location on the first base plate. In one form of the invention each guide rail includes, e.g. on an undersurface, at least one magnet and the first base plate includes at least one metallic strip with which the magnet is engageable with the guide rail at a selected position on the first base plate.

BRIEF DESCRIPTION OF THE DRAWINGS

The invention is further described by way of examples with reference to the accompanying drawings in which.

DESCRIPTION OF PREFERRED EMBODIMENTS

Figures 1, 1A:
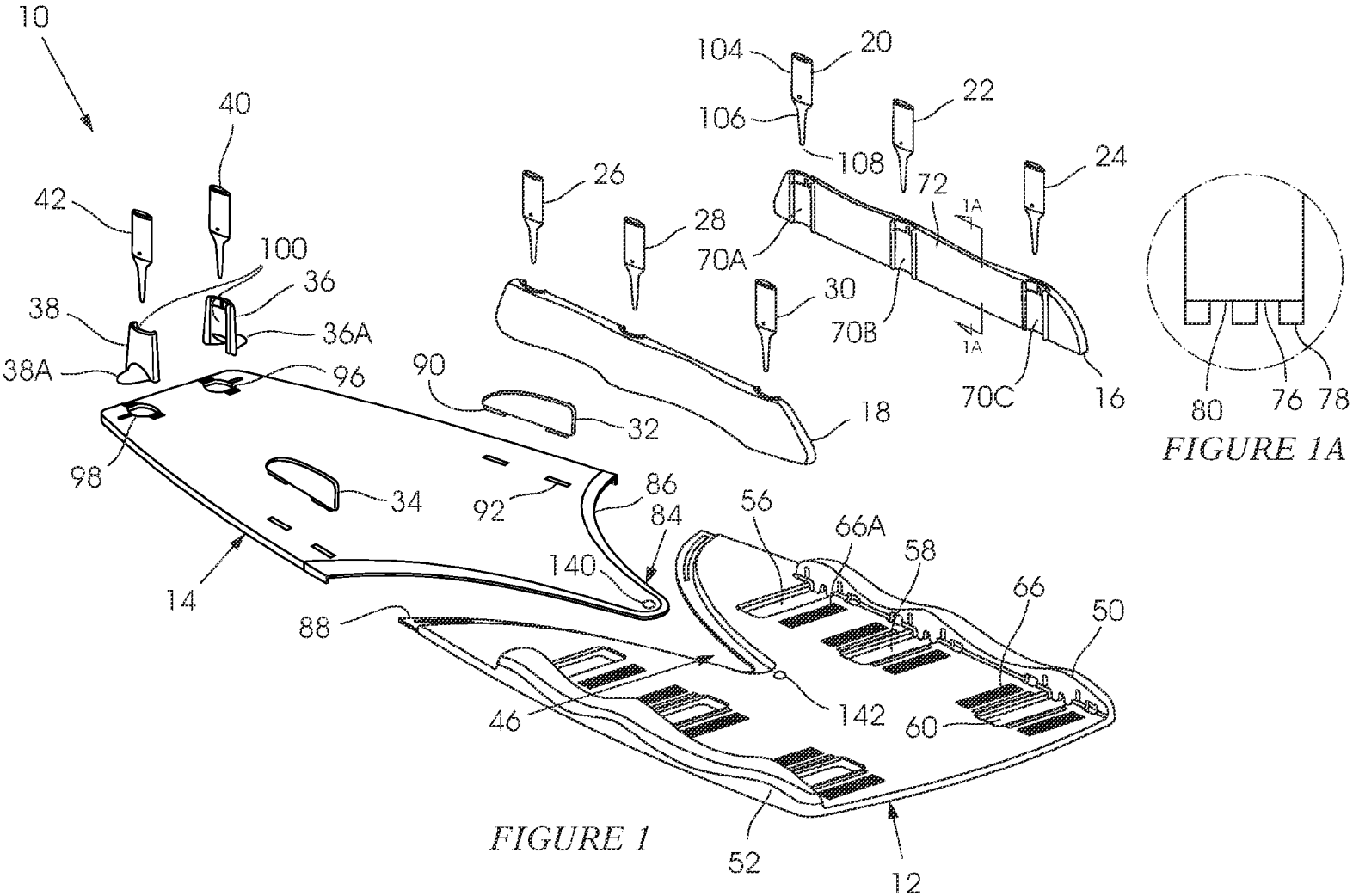
FIG. 1 is an exploded view in perspective of a putting aid according to the invention.

FIG. 1 of the accompanying drawings illustrates, in an exploded configuration, a putting aid 10 according to one form of the invention.

The putting aid includes a first ground-engaging base plate 12, a second ground-engaging base plate 14, first and second guide rails 16 and 18 respectively, various markers 20 to 30 which are usable together with the first and second guide rails, guiding flanges 32 and 34 respectively, guide members 36 and 38 respectively, and additional markers 40 and 42.

Each base plate is made from any suitable material e.g. a plastic material which may be over-moulded, coloured, patterned, or carry distinctive markings which assist in golf strokes, according to requirement.

The first base plate 12 has a curved V-shaped formation 46 on one side, and spaced-apart substantially parallel abutments 50 and 52 respectively along opposed longitudinal edges of the base plate. The base plate has three elongate slots 56, 58 and 60 respectively which extend generally parallel to one another from the abutment 50 in a direction towards the abutment 52. The slots 58 and 60 are flanked by arrays (each designated 66) of alternating rib and slot sequences. The slot 56 has a single array designed 66A on one side.

The opposing side of the base plate, i.e. adjacent the abutment 52, has a similar construction to that provided adjacent the abutment 50.

The guide rails 16 and 18 are mirror images of each other. Each guide rail is made from a suitable, slightly resilient and deformable, plastics material. Each guide rail has three guide formations 70A, 70B and 70C respectively which are spaced from each other and which provide a substantially flat surface 72 which, in use, is vertically orientated.

Optionally, though, each guide rail is made from at least one flexible component within which one or more relatively rigid elements are at least partly embedded. This provides a good compromise between strength (rigidity) and flexibility.

An insert drawing in FIG. 1 illustrates on an enlarged scale and in cross-section a lower side of the guide rail 16 taken on a line 1A-1A. The guide rail has an undersurface 76 which is formed with at least one projection 78.

The second ground-engaging base plate 14 is made from a similar material to the first base plate 12. The base plate 14 has a formation 84 which is of complementary shape to the V-shaped formation 46. The formation 84 has a flange 86 which fits over a receiving receptacle 88 of complementary shape to the flange located on the base plate 12.

The guide members 36 and 38 can be engaged with apertures 96 and 98 respectively which are formed in the second base plate and which are of complementary shape to formations provided on respective stabilising bases 36A and 38A of the guide members. These guide members have guide formations 100 which are similar to the guide formations 70A, 70B and 70C.

The markers 20 to 30, and 40 and 42, are similar in shape and form to one another. Each marker has a relatively large body 104 which, in cross-section, has the shape of an elongate oval, and a downwardly extending tapered section 106 which terminates in a ground-engaging formation which, in this case, is in the form of a ground-penetrating point 108. The markers 40 and 42 may be different in size to the markers 20 to 30.

Figure 2:
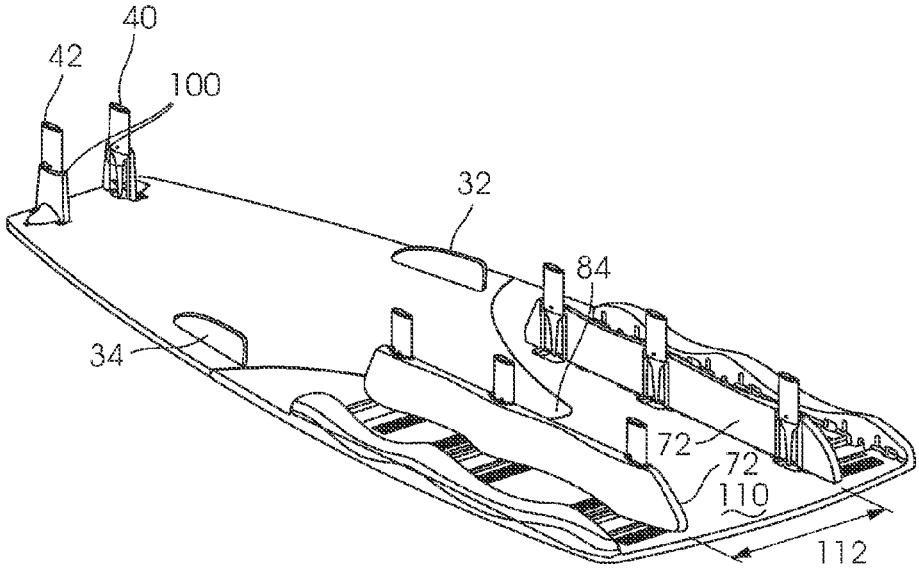
FIGS. 2 and 3 are views of the putting aid of FIG. 1, in an assembled arrangement, with the putting aid in different training configurations.
Figure 3:
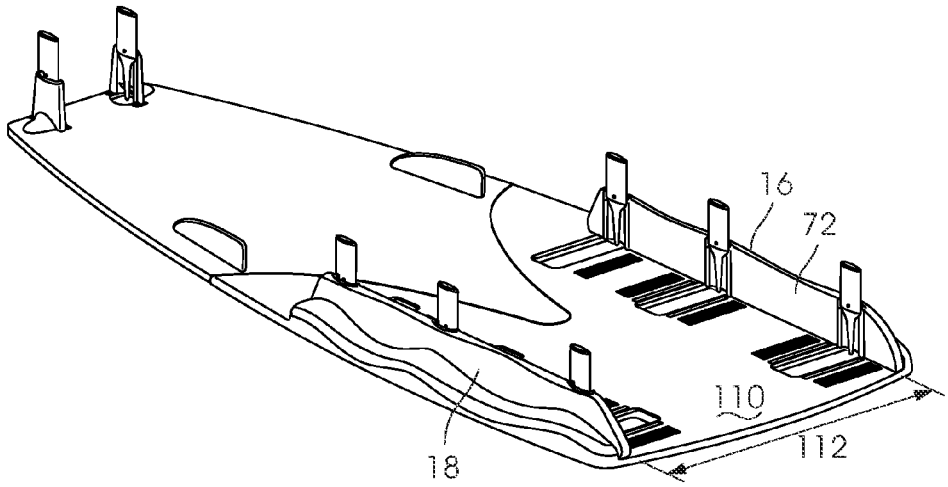

FIG. 2 and FIG. 3 show the putting aid of FIG. 1 in an assembled mode. The projections 78 on the underside of each guide rail can be placed at selected locations into engagement with the respective rib and slot arrays 66 and 66A. The various markers are lightly engaged with the respective guide formations 70A to 70C, and 100. At least one guiding flange 32 or 34 (both shown) is coupled to the second base plate and the formation 84 on the second base plate is snugly engaged with the V-shaped formation 46 on the first base plate. The base plates are accurately and securely kept in engagement with each other by means of the flange 86 and receptacle 88 which, as noted, slip into complementary recesses. The guide rails 16 and 18 have respective surfaces 72 which are generally vertically orientated and which oppose each other. A guide passage 110 is defined between the opposing surfaces. The passage has a variable width 112 which is determined by the positions at which the guide rails are connected to the respective arrays 66 and 66A.

Figure 4:
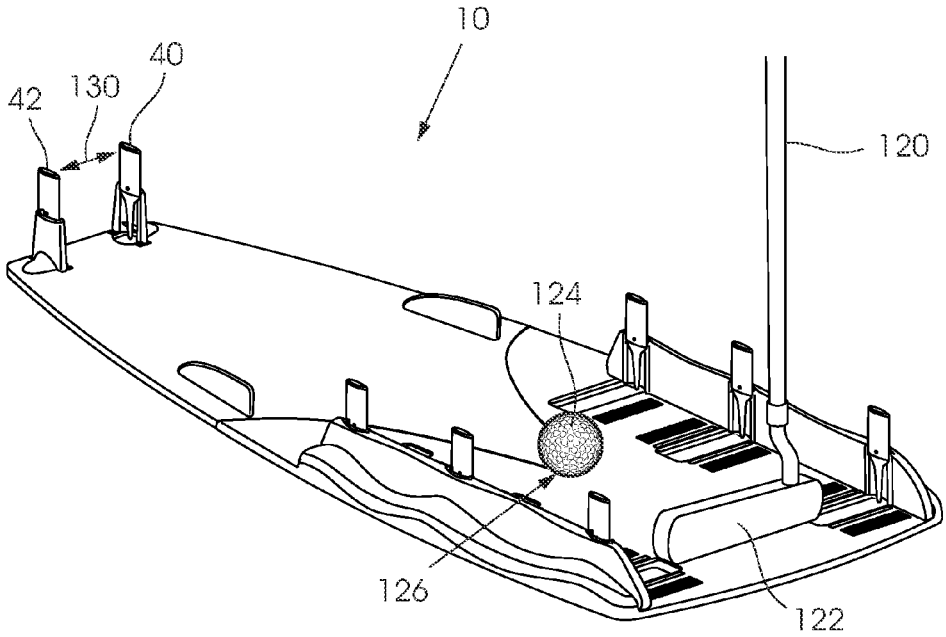
FIG. 4 shows the putting aid of FIG. 3 during a practice stroke.

FIG. 4 illustrates the putting aid 10, in the FIG. 3 mode, during a practice putting stroke. A putter 120 which is held by a user, not shown, has a putting head 122. A golf ball 124 is positioned accurately at a narrow end 126 of the V-shaped formation 46. The user can then practice a putting stroke with the putter head moving along the guide passage. The putter head, viewed in plan, should be at a right angle to the direction of movement along the passage so that the golf ball 124 can pass through a relatively narrow gap 130 formed between the markers 40 and 42.

The putting aid 10 is adjustable in various respects to cater for particular situations and to allow the aid to be used even though a golfer might be improving progressively in putting capability.

Figure 5:
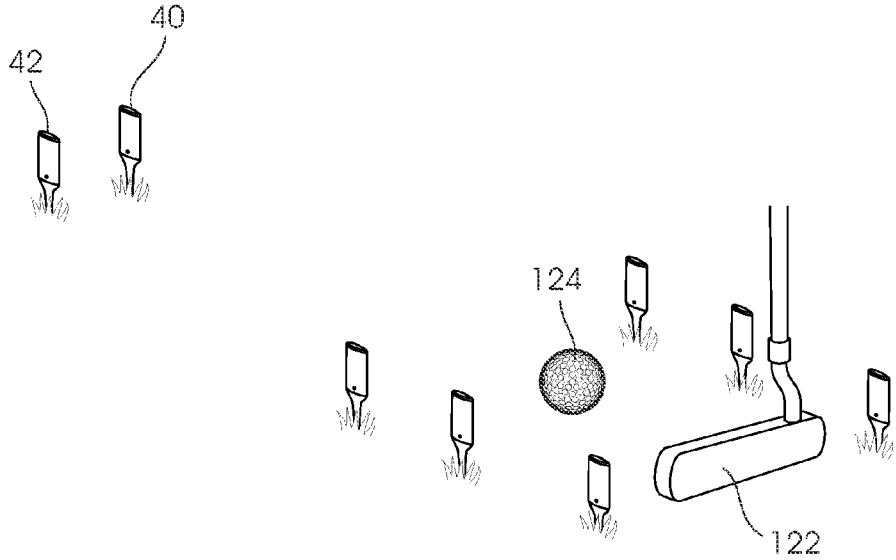
FIG. 5 illustrates a situation which results when base plates of the putting aid are removed.
Figure 6:
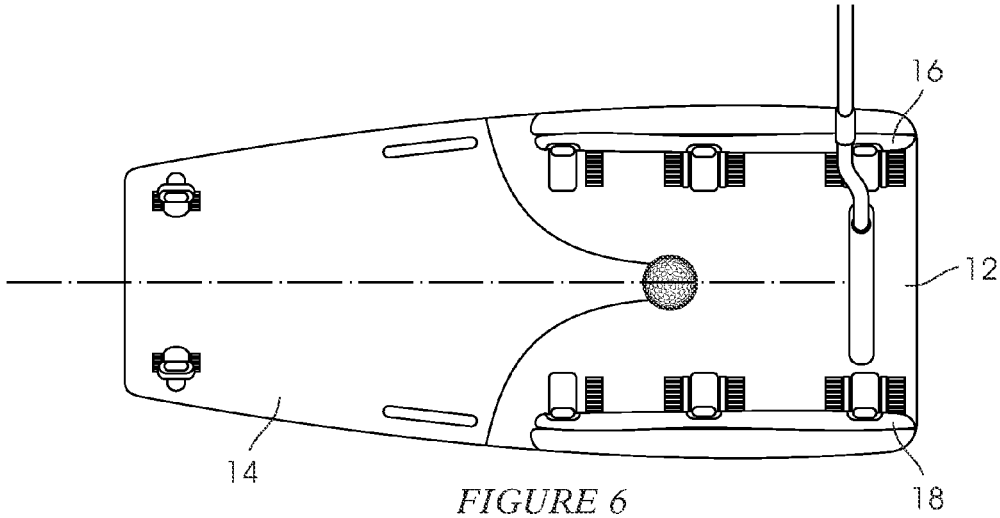
FIG. 6 is a plan view of the arrangement shown in FIG. 4.
Figure 7:
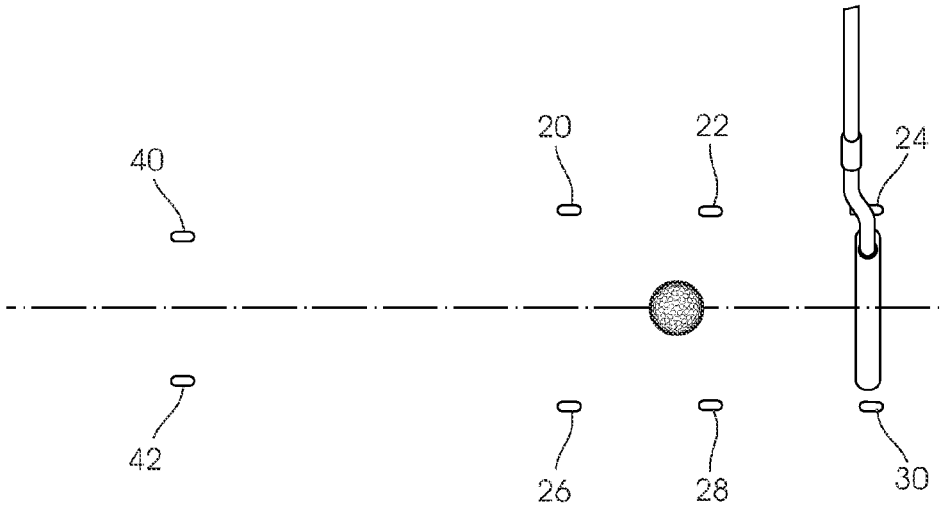
FIG. 7 is a plan view of the arrangement shown in FIG. 5.

For example, as is shown in FIG. 2, the width 112 of the passage defined between the opposing surfaces 72 of the guide rails can be adjusted so that in a limiting position the putter head 122 can move with minimal clearance between the surfaces, provided of course that the golfer has sufficient skill. Secondly, the markers can be engaged with the ground. In this embodiment the markers are driven into the ground through the slots 56, 58, 60 and 96, 98 respectively. The guide rails are generally vertically orientated, and so are the guide formations. Consequently the markers are also vertical, when driven into the ground. The guide rails and the first base plate can then be removed leaving the markers embedded in the ground. If required the guide rails can be re-engaged with the markers i.e. in the absence of the first base plate. This helps to promote user-confidence in the execution of a putting stroke. In this configuration the second base plate is uplifted leaving the markers 40 and 42 in position, and the golf ball 124 is placed on the ground for a putting stroke FIGS. 5 and 7 show the markers in perspective and in plan respectively with the base plates and the guide rails removed.

Another adjustment which can be effected is to reduce the number of markers from the group 20 to 30 gradually; initially, say to four, and then to two.

Figure 8:
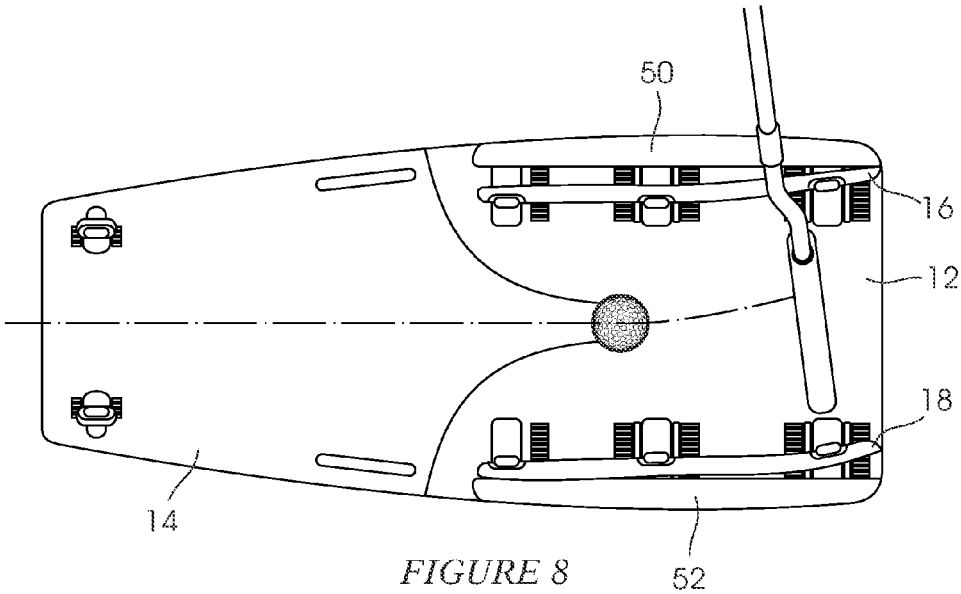
FIG. 8 is similar to FIG. 6 but illustrating how the putting aid can be used to allow for a curved putting stroke.

A further feature of the putting aid of the invention is its ability to cater for a golfer who does not have a linear putting stroke but who executes a putting stroke with a curved motion. As the guide rails are slightly flexible it is possible, as is shown in FIG. 8, for one or both of the guide rails to be bent slightly and to follow slightly curved paths, although the guide rails still remain generally parallel to each other. FIG. 8 illustrates a configuration for a left-handed golfer but, if the guide rails are bent in an opposite direction, the resulting curved configuration would be suitable for a right-handed golfer.

Figure 9:
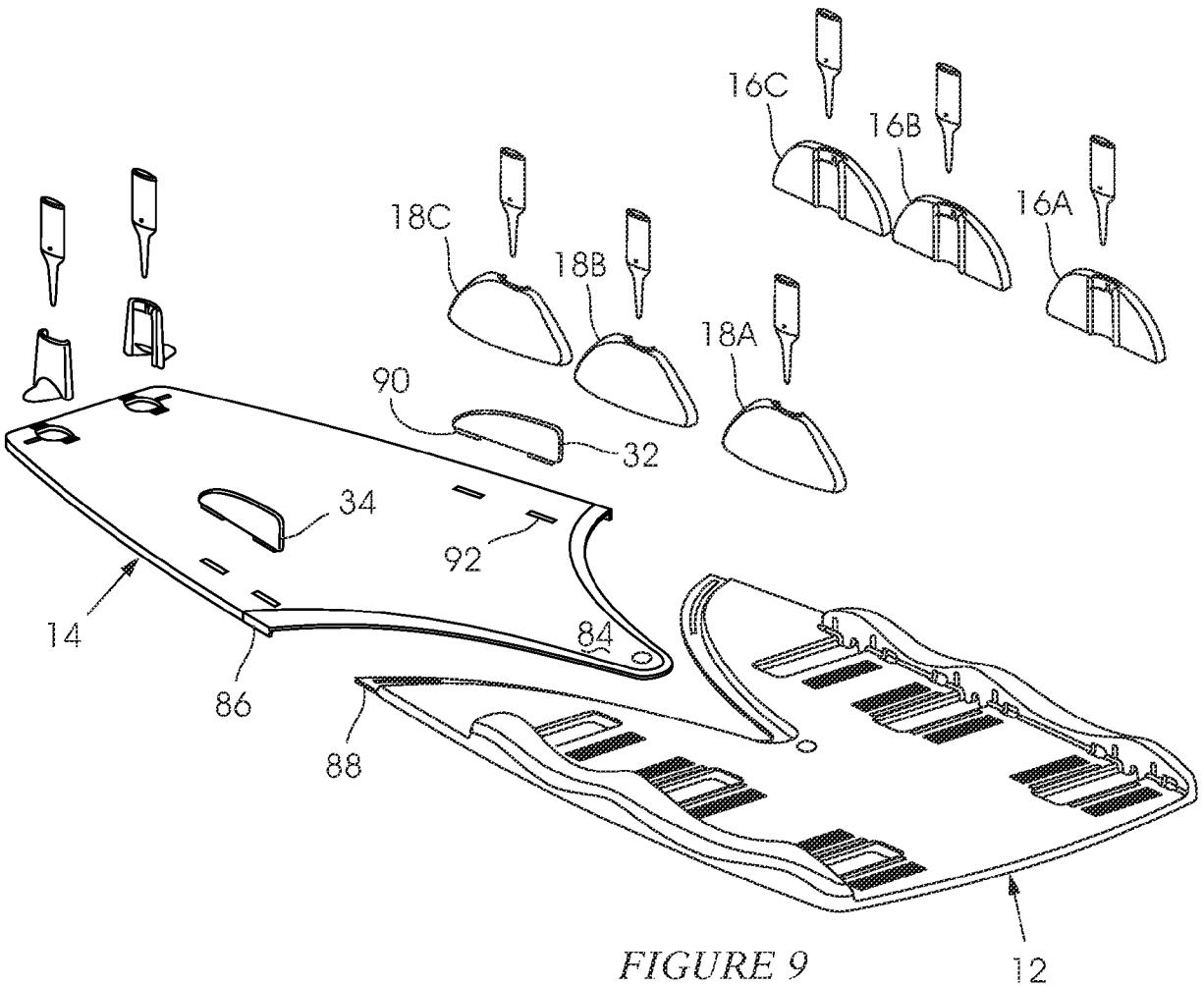
FIG. 9 is an exploded view in perspective, similar to FIG. 1, illustrating a version of the putting aid in which multiple guide rails may be utilised.

FIG. 9 illustrates in perspective the putting aid 10. The guiding flanges 32 and 34 have downwardly extending projections 90 which can be inserted with a tight fit into complementary slots 92 so that the flanges are fixed to the base plate 14 in vertically extending orientations. An alternative arrangement of the guide rails 16 and 18 is shown in which the guide rails 16 and 18 are segmented. Each segment (16A . . . 16N; 18A . . . 18N) can hold at least one marker, or can be used without a marker.

Figure 10:
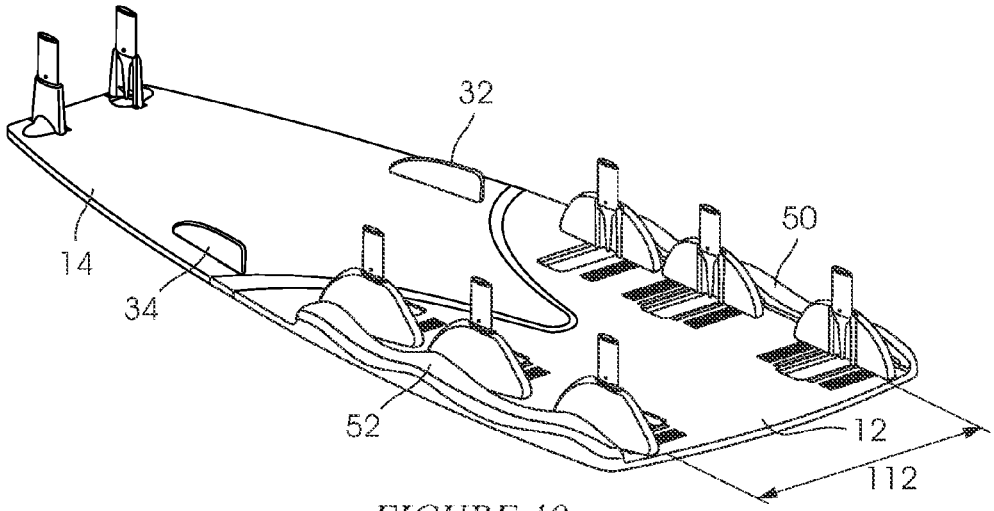
FIG. 10 and FIG. 11 are respective views of the putting aid according to FIG. 9, in an assembled arrangement, in different training configurations.
Figure 11:
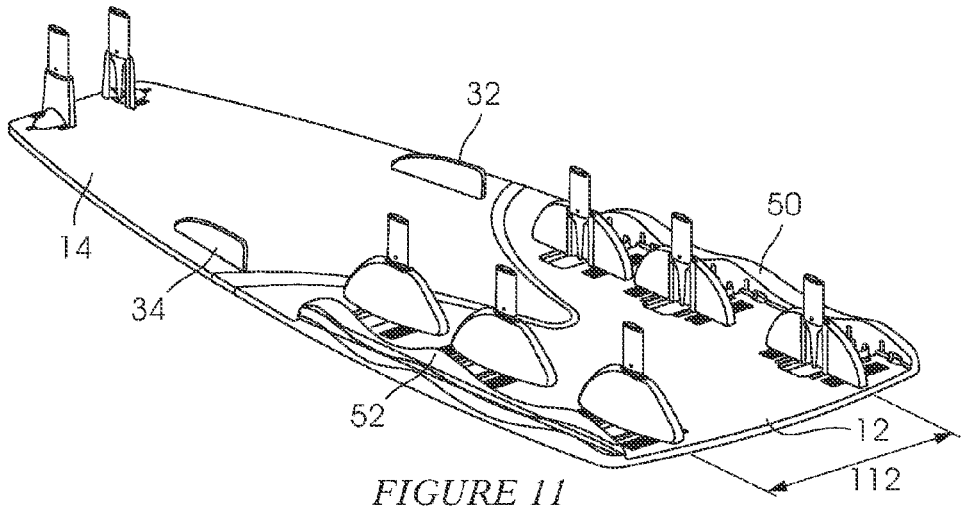

FIG. 10 is a perspective view of an embodiment of the putting aid, wherein the passage created between the guide rails, which are segmented, is broad for a first time user. In FIG. 11 the width of the passage has been reduced, for an experienced user.

Figure 12:
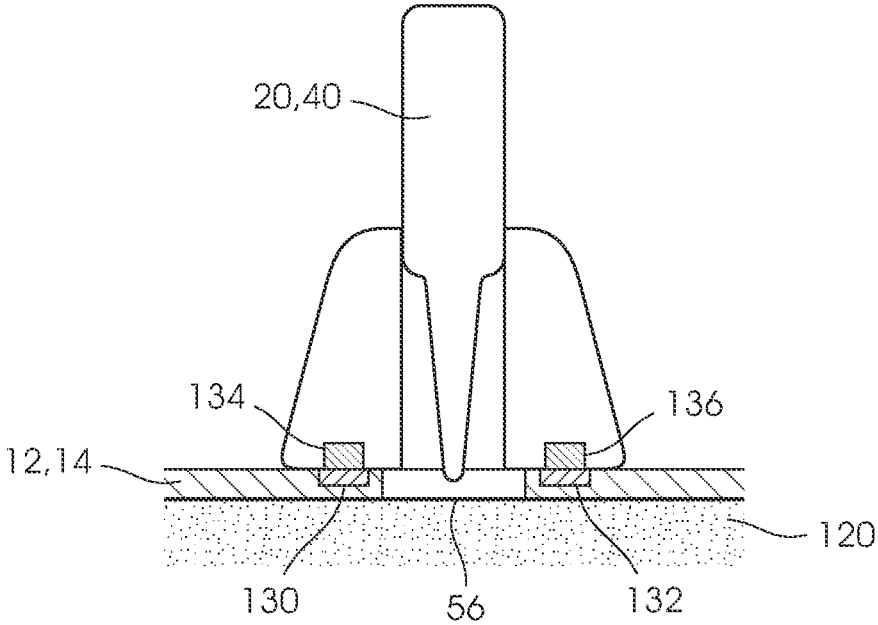
FIG. 12 is a front view of a guide rail, and a marker in a rest position.

FIG. 12 is a front view of a guide rail in which the respective marker 20 to 30, or 40 and 42, is held above the ground 120, and wherein the respective ground-engaging base plate 12 or 14, as the case may be, rests on the ground.

Figure 13:
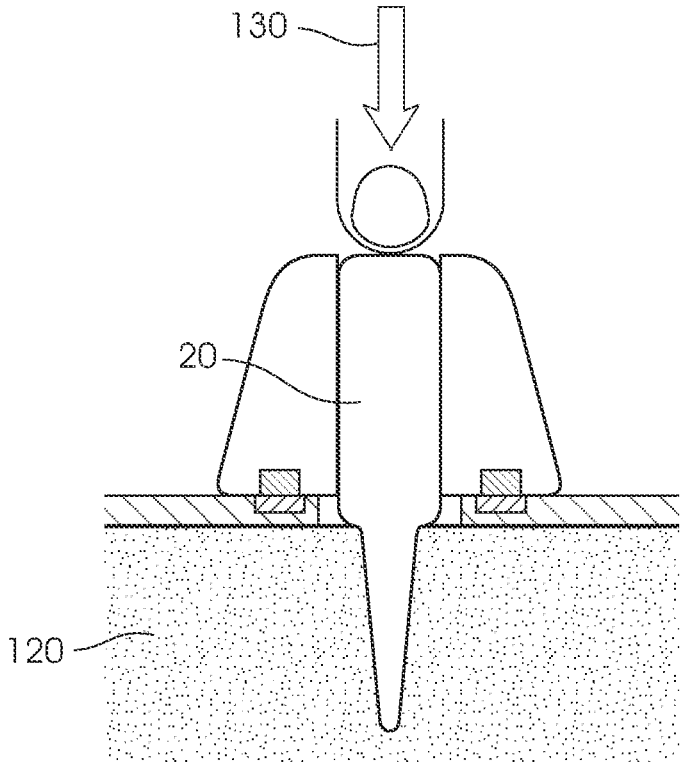
FIG. 13 is a front view of a guide rail, and a marker in an activated position.

FIG. 13 shows a marker 20 being moved, relative to a guide rail and to a ground-engaging base plate, as a result of a downward force applied manually to the marker in the direction of an arrow 130. The marker is caused to penetrate the ground 120 and then remains in this position. This feature allows for the removal of the ground-engaging base plates and guide rails, with the option of then being able to re-engage the guide rails with the markers, if desired, i.e. in the absence of the base plate.

The use of a ground-penetrating formation on a marker is preferred, but is not essential. Depending on the nature of the "ground" other ground-engaging techniques can be used e.g. the markers could be magnetically engaged with the ground, or they could be fixed to the ground using fasteners which include hook and eye material such as Velcro™.

It is advantageous to embed in the first base plate (at least) thin parallel pairs of metallic strips 130, 132, which flank each respective slot 56, 58 and 60 (see FIG. 12). Small magnets 134, 136 respectively are embedded in an underside of the guide rail 16, 18 or the segments of each guide rail. The magnets are spaced to be aligned with the strips 130, 132. This feature, which is used in place of, or in addition to, the projections 78 and the rib and slot arrays (66, 66A), is surprisingly useful for it allows the positions of the guide rails to be adjusted easily and rapidly.

Another variation is to replace the guiding flanges 32, 34 with raised sections which are integrally formed with the second base plate. This reduces the component count in the putting aid, and helps to stiffen the second base plate.

Preferably the second base plate has a small, precisely positioned hole 140 (or the first base plate has a similar hole 142) which allows a user to mark the underlying ground. If this is done then, when the base plates are removed, the user has an indication of the position on the ground at which a golf ball should be located.

The invention claimed is:

1. A putting aid which includes a first ground-engaging base plate, at least first and second guide rails, which are attached to the first base plate, a first surface on the first guide rail, a second surface on the second guide rail, the first surface opposing the second surface, the first and second surfaces being spaced apart by a selected width to form at least part of a guide passage for a putting stroke of a putter, the first and second guide rails being relatively movable to adjust said selected width, at least a first marker engaged with the first guide rail and at least a second marker engaged with the second guide rail, each marker including a respective ground-engaging formation, which is engageable with the ground at a respective defined position, and wherein the first base plate, and the guide rails, are then movable, leaving said markers at said respective defined positions.

2. A putting aid according to claim 1 wherein each guide rail, in plan, follows a defined straight, or curved, path.

3. A putting aid according to claim 1 wherein the first base plate includes a receiving formation to receive a golf ball which is positioned so that a putter head is required to travel a distance between the guide rails before making contact with the golf ball.

4. A putting aid according to claim 1 which includes a second ground-engaging base plate which is engageable with the first base plate in a predetermined configuration, and at least third and fourth markers engaged with the second base plate, each said third and fourth marker including a respective ground-engaging formation which is engageable with the ground at a respective defined position, and wherein the second base plate is then movable leaving said third and fourth markers at said defined respective positions.

5. A putting aid according to claim 4 wherein the second base plate includes a receiving formation to receive a golf ball which is positioned so that a putter head is required to travel a distance between the guide rails before making contact with the golf ball.

6. A putting aid according to claim 4 wherein the respective ground-engaging formation on each third and fourth marker is a ground-penetrating formation and the marker is movable relative to the second base plate to cause said ground-penetrating formation to penetrate the ground at said respective desired position.

7. A putting aid according to claim 4 wherein the second base plate is movable, leaving said third and fourth markers at said respective positions.

8. A putting aid according to claim 4 wherein the ground-engaging formation of each third and fourth marker includes a magnet which is engageable with an underlying surface of the ground which exhibits magnetic properties.

9. A putting aid according to claim 1 wherein the respective ground-engaging formation on each marker is a ground-penetrating formation and the marker is movable relative to the first base plate to cause said ground-penetrating formation to penetrate the ground at said respective defined position.

10. A putting aid according to claim 1 wherein the first base plate and the guide rails are movable, in unison or separately, leaving said markers at said respective positions.

11. A putting aid according to claim 1 wherein, after said movement of the first base plate and the guide rails, the guide rails are optionally re-engageable with the markers which are at said respective defined positions.

12. A putting aid according to claim 1 wherein the ground-engaging formation of each marker includes a magnet which is engageable with an underlying surface of the ground which exhibits magnetic properties.

13. A putting aid according to claim 1 wherein each guide rail includes at least one magnet and the first base plate includes at least one metallic strip with which the magnet is engageable with the guide rail at a selected position on the first base plate.

* * * * *